US008790192B2

(12) United States Patent
Narita et al.

(10) Patent No.: US 8,790,192 B2
(45) **Date of Patent: *Jul. 29, 2014**

(54) PUTTER HEAD

(75) Inventors: Tadahiro Narita, Chichibu (JP); Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 142 days.

This patent is subject to a terminal disclaimer.

(21) Appl. No.: 13/164,403

(22) Filed: Jun. 20, 2011

(65) Prior Publication Data

US 2011/0319188 A1 Dec. 29, 2011

(30) Foreign Application Priority Data

Jun. 29, 2010 (JP) ..... 2010-147857
Aug. 23, 2010 (JP) ..... 2010-186355

(51) Int. Cl.
*A63B 53/04* (2006.01)

(52) U.S. Cl.
USPC ..... 473/329; 473/332; 473/340; 473/342

(58) Field of Classification Search
CPC ..... A63B 53/0487; A63B 53/065; A63B 2053/0425; A63B 2053/0458
USPC ..... 473/324–350
See application file for complete search history.

(56) References Cited

U.S. PATENT DOCUMENTS

| | | | | |
|---|---|---|---|---|
| 1,154,490 | A | 9/1915 | Davis | |
| 1,359,220 | A | 11/1920 | Beamer | |
| 1,854,548 | A | 4/1932 | Hunt | |
| 3,061,310 | A | 10/1962 | Giza | |
| 3,084,940 | A * | 4/1963 | Cissel | 473/332 |
| D209,301 | S | 11/1967 | Comitz | |
| 3,989,248 | A | 11/1976 | Campau | |

(Continued)

FOREIGN PATENT DOCUMENTS

| | | | |
|---|---|---|---|
| JP | 2001-062008 | A | 3/2001 |
| JP | 2007-117635 | A | 5/2007 |
| WO | 2009/143052 | A1 | 11/2009 |

OTHER PUBLICATIONS

Japanese Office Action, dated Jan. 7, 2014, issued in corresponding Japanese Patent Application No. 2010-147857.

*Primary Examiner* — Sebastiano Passaniti
(74) *Attorney, Agent, or Firm* — Sughrue Mion, PLLC

(57) ABSTRACT

A putter head has a head main body and a face insert mounted on a face surface of the head main body. The face insert has a slit which is cut in from an end face on a sole or top side of the face insert toward an opposite side thereof. In one embodiment, the slit is cut in from an end face on the sole side of the face insert toward the top side thereof. The slit may be extended obliquely such that the top side of the slit is located forward of the face insert. In another embodiment, the slit is cut in from the side face on the top side of the face insert toward the sole side thereof. The slit may be extended obliquely such that the sole side of the slit is located rearward of the putter head. Any slit may be extended from the side face on a toe side of the face insert to the side face on a heel side thereof. The face inserts may contain viscoelastic material loaded in the slit.

7 Claims, 9 Drawing Sheets

(56) References Cited

U.S. PATENT DOCUMENTS

| | | | | | |
|---|---|---|---|---|---|
| 4,679,792 | A | * | 7/1987 | Straza et al. | 473/329 |
| 4,681,322 | A | * | 7/1987 | Straza et al. | 473/329 |
| 5,328,175 | A | | 7/1994 | Yamada | |
| 5,464,212 | A | * | 11/1995 | Cook | 473/329 |
| 5,620,381 | A | * | 4/1997 | Spalding | 473/329 |
| 5,766,093 | A | * | 6/1998 | Rohrer | 473/329 |
| 6,083,117 | A | * | 7/2000 | Hsu | 473/332 |
| 6,086,485 | A | * | 7/2000 | Hamada et al. | 473/329 |
| 6,200,229 | B1 | * | 3/2001 | Grace et al. | 473/324 |
| 6,227,986 | B1 | * | 5/2001 | Fisher | 473/342 |
| 6,334,818 | B1 | | 1/2002 | Cameron et al. | |
| 6,390,932 | B1 | | 5/2002 | Kosmatka et al. | |
| 6,695,715 | B1 | | 2/2004 | Chikaraishi | |
| 6,699,140 | B1 | * | 3/2004 | Sun | 473/252 |
| 6,951,518 | B2 | | 10/2005 | Solheim et al. | |
| 6,979,270 | B1 | | 12/2005 | Allen | |
| 7,101,290 | B2 | * | 9/2006 | Tucker, Sr. | 473/340 |
| 7,134,971 | B2 | * | 11/2006 | Franklin et al. | 473/340 |
| 7,273,420 | B2 | * | 9/2007 | Wright | 473/329 |
| 7,278,926 | B2 | * | 10/2007 | Frame | 473/329 |
| 7,354,356 | B2 | | 4/2008 | Yamanaka et al. | |
| 7,713,139 | B1 | * | 5/2010 | Stites et al. | 473/329 |
| 7,824,278 | B2 | * | 11/2010 | Miyamichi | 473/329 |
| 7,942,757 | B2 | * | 5/2011 | Blumenkrantz et al. | 473/331 |
| 8,012,035 | B2 | * | 9/2011 | Franklin et al. | 473/251 |
| 8,066,587 | B2 | * | 11/2011 | Tateno et al. | 473/331 |
| 8,083,611 | B2 | * | 12/2011 | Kuan et al. | 473/340 |
| 8,622,850 | B2 | | 1/2014 | Narita et al. | |
| 2003/0216191 | A1 | * | 11/2003 | Wright et al. | 473/288 |
| 2003/0220156 | A1 | * | 11/2003 | Solheim | 473/340 |
| 2005/0009623 | A1 | * | 1/2005 | Dickinson | 473/329 |
| 2005/0020378 | A1 | * | 1/2005 | Krumme et al. | 473/332 |
| 2007/0099723 | A1 | | 5/2007 | Tateno | |
| 2008/0020860 | A1 | * | 1/2008 | Imamoto | 473/332 |

* cited by examiner

PUTTER HEAD

CROSS-REFERENCE TO RELATED APPLICATION

This application claims priority from Japanese Patent Application No. 2010-147857 filed Jun. 29, 2010, and Japanese Patent Application No. 2010-186355 filed Aug. 23, 2010, which are incorporated herein by reference in their entirety.

BACKGROUND OF THE INVENTION

The present invention relates to a golf putter head, more particularly to a putter head containing a face insert mounted in a face surface of a head main body thereof.

The putter of golf is used mainly for putting a ball on a green to roll the ball toward a cup. Japanese Unexamined Patent Application Publication No. 2007-117635 has described a putter head which is so constructed to soften a feeling on putting by mounting a face insert in a face surface thereof.

Japanese Unexamined Patent Application Publication No. 2001-62008 has described a putter head in which synthetic resin foam is provided integrally on a bottom portion of the face surface of the putter head to enable a player to easily apply top spin to the ball. However, because the synthetic resin foam has a high temperature dependency, a way in which the top spin is applied to the ball changes considerably depending on the temperature.

SUMMARY OF THE INVENTION

An object of the present invention is to provide a putter head in which when a ball is putted, spin such as back spin and top spin of the ball can be improved as compared to ordinary putters.

Another object of the present invention is to provide a putter head in which when a ball is putted, back spin is reduced as compared to ordinary putters, so that top spin is easily applied to the ball while temperature dependency of easiness of applying the top spin is low. Still another object of the present invention is to provide a putter head in which when the ball is putted, the top spin is reduced as compared to ordinary putters while back spin is easily applied.

According to a first aspect of the present invention, there is provided a putter head comprising: a head main body; and a face insert mounted in a face surface of the head main body, wherein the face insert has a slit which is cut in from an end face on a sole or top side of the face insert toward an opposite side thereof.

According to a second aspect of the present invention, there is provided a putter head comprising: a head main body; and a face insert mounted in a face surface of the head main body, wherein the face insert has a slit which is cut in from a side face on a sole side of the face insert or from a lower portion of the front face or the back face thereof toward the top side of the face insert. Because the face insert is provided with the slit which is cut in from the side face of the face insert or from the lower portion of the front face or the back face thereof, when a ball is hit, the lower portion of the face insert is retracted and consequently, back spin is reduced and top spin is applied more easily, thereby improving straight advancing characteristic of the hit ball.

The slit may be extended from the side face on a toe side of the face insert to the side face on a heel side thereof. The slit may be extended obliquely such that a top side of the slit is located more forward of the putter head. The face insert may contain viscoelastic material loaded in the slit. By loading viscoelastic material in the slit, hitting sound and feel on putting a ball can be adjusted.

According to a third aspect of the present invention, there is provided a putter head comprising: a head main body; and a face insert mounted in a face surface of the head main body, wherein the face insert has a slit which is cut in from a side face on the top side or an upper portion of the front face or the back face toward the sole side of the face insert.

Because the face insert is provided with the slit which is cut in from the side face on the top side of the face insert or from the upper portion of the front face or the back face thereof toward the sole side thereof, when the putter head putts a ball, the upper portion of the face insert is retracted and the top spin is reduced and the back spin is more easily applied to the ball. Consequently, when using a putter head having such characteristics on a little rough green or a green which ensures an excellent rolling of the ball, a player can adjust feel on a distance on the green because the rolling performance of the ball is degraded.

The slit may be extended from the side face on a toe side of the face insert to the side face on a heel side thereof. The slit may be extended obliquely such that the sole side of the slit is located rearward of the putter head. The face insert may contain viscoelastic material loaded in the slit. Therefore, hitting sound and feel on putting a ball can be adjusted by filling the slit with visoelastic material.

DETAILED DESCRIPTION OF THE PREFERRED EMBODIMENTS

Hereinafter, the embodiments of the present invention will be described with reference to the accompanying drawings.

Figure 1A:
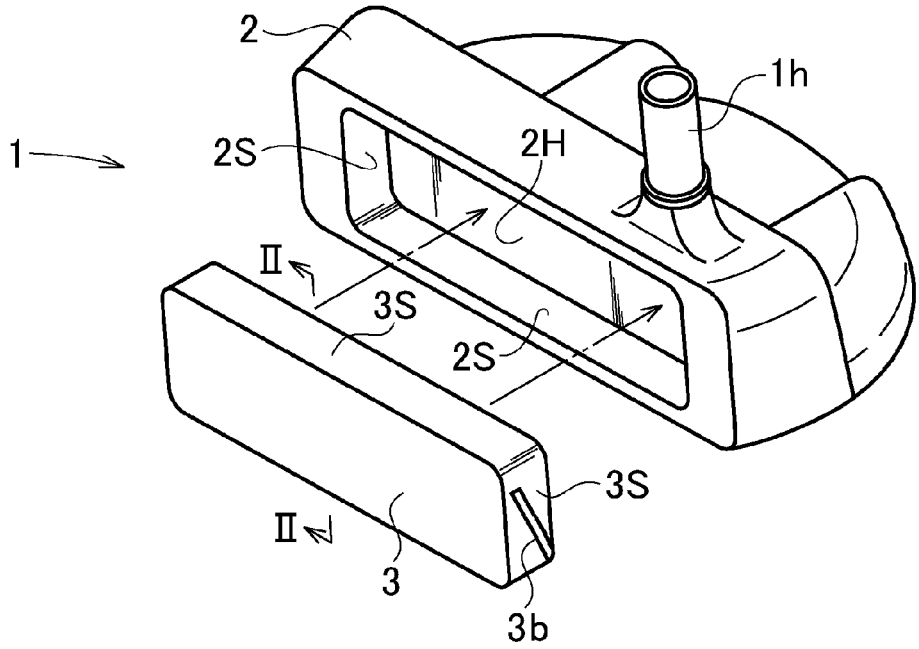
FIG. 1A is an exploded perspective view of a putter head according to a first embodiment of the present invention.
Figure 1B:
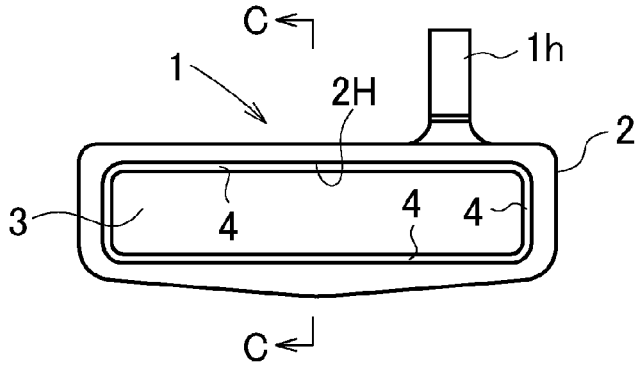
FIG. 1B is a front view of the putter head of FIG. 1A.
Figure 1C:
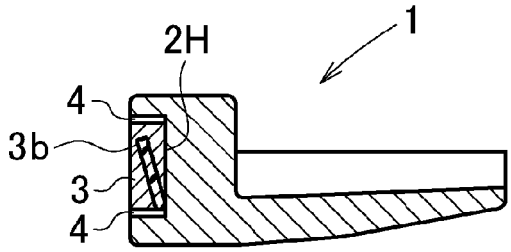
FIG. 1C is a sectional view of the putter head taken along the line C-C of FIG. 1B.
Figure 2:
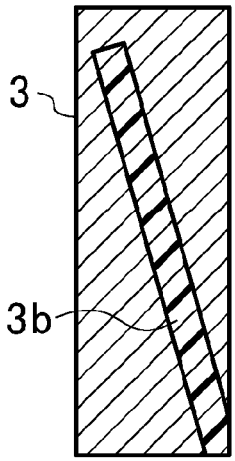
FIG. 2 is a sectional view of a face insert taken along the line II-II of FIG. 1A.

FIGS. 1 and 2 show a putter head 1 according to a first embodiment of the present invention. This putter head 1 is provided with a concave portion 2H in the front face (face surface) of a head main body 2 and a face insert 3 is disposed within this concave portion 2H. According to this embodiment, the head main body 2 is made of metal such as aluminum alloy, titanium alloy, copper alloy, and stainless steel. The face insert 3 is made of synthetic resin such as polyester, nylon, urethane or metal such as aluminum alloy, copper alloy, and stainless steel. A front face of the face insert 3 is flush with a front face of the head main body 2 around the concave portion 2H.

The concave portion 2H and the face insert 3 are of a substantially rectangular shape which is horizontally long. The depth of the concave portion 2H is entirely even and the thickness of the face insert 3 is entirely even. However, the face insert may be provided partly with a deep portion or a thick portion or may be provided partly with a shallow portion or a thin portion.

The lateral and vertical widths of the face insert 3 are slightly smaller than those of the concave portion 2H and there is a slight gap 4 between top, bottom, right and left side faces 3S of the face insert 3 and the peripheral face 2S of the concave portion 2H. Preferably, the width of this gap 4 is 0.3 to 1.5 mm, particularly 0.4 to 1.0 mm. Regarding the size of the face insert 3, its vertical width is preferred to be 16 to 30 mm, particularly 18 to 25 mm, its lateral width is preferred to be 50 to 150 mm, particularly 70 to 100 mm and its thickness is preferred to be 2 to 10 mm, particularly 3 to 8 mm. However, they are not limited to these values.

Figure 3:
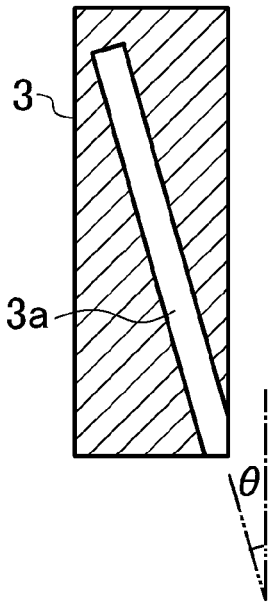
FIG. 3 is a sectional view of the face insert of FIG. 2 from which viscoelastic member is removed.

As shown in FIGS. 2 and 3, this face insert 3 contains a slit 3*a* which is provided to be extended from an end face of its bottom portion (sole side) upwardly (top side) and the slit 3*a* is filled with viscoelastic material 3*b*. The viscoelastic material is composed of rubber, elastomer or soft elastic resin.

According to this embodiment, the bottom end of the slit 3*a* is located on the bottom end of a side face and a back surface on the sole side of the face insert 3 and the slit 3*a* is extended from the bottom end such that an upper portion thereof is tilted toward the front surface of the putter head (leftward in FIGS. 2 and 3).

The slit 3*a* is extended from the left end to the right end of the face insert 3 (from a side face on the toe side to a side face on the heel side). That is, the face insert 3 has a substantially C-shaped configuration directed downward in which its front face side portion and its rear face side portion are combined continuously at a top portion thereof. An angle θ (FIG. 3) of the slit 3*a* is preferred to be in a range of 0° which means a perpendicular state to the ground to +35° and more preferred to be in a range of 0° to +25°. In the meantime, "+" means an inclination toward the back face of the putter head with respect to the perpendicular state. Preferably, the height of the slit 3*a* (a difference in height between the top end and the bottom end of the slit 3*a*) is 60% to 95% the height of the face insert 3, more preferably 70% to 90%.

The face insert 3 is disposed within the concave portion 2H such that its left side face in FIG. 2 serves as a face surface of the putter head and an opposite side face is bonded to a deep wall surface of the concave portion 2H with adhesive. As the adhesive, epoxy based adhesive, rubber based adhesive, or double-sided adhesive tape is preferred; however, it is not limited to these.

The putter is configured by connecting a shaft to a hosel portion 1*h* of the putter head 1 having the above-described configuration. Assuming that a ball is putted with this putter (putting a ball on a green with the face surface), when the ball is hit, the front face side (face side with respect to the slit 3*a*) of the face insert 3 is retracted slightly, and thereby top spin is applied more easily and straight advancing characteristic of the hit ball is improved.

Figures 4A, 4B, 4C:
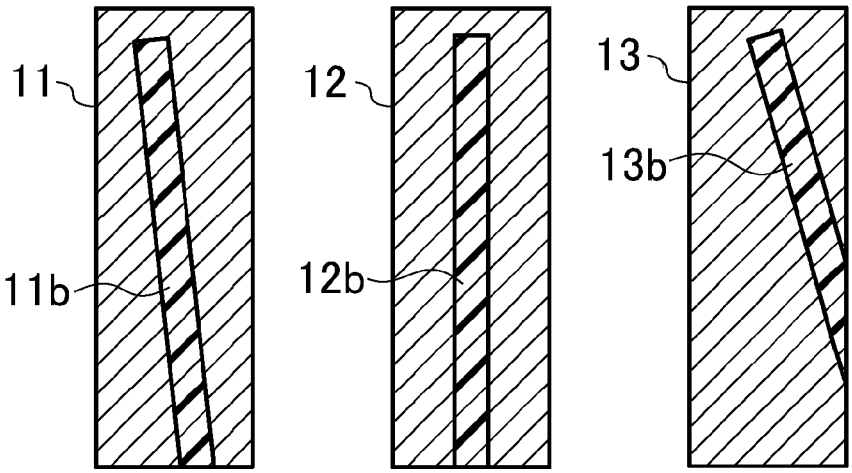
FIG. 4 shows sectional views of face inserts according to modified examples.
Figures 5A, 5B, 5C:
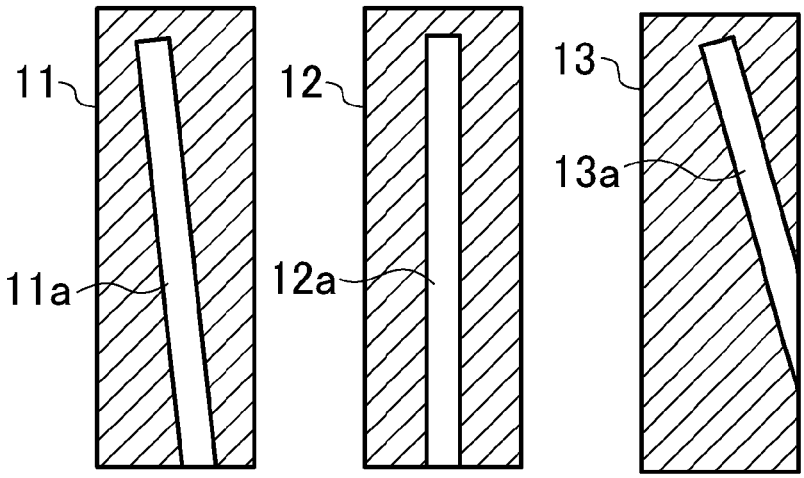
FIG. 5 shows sectional views of the face inserts of FIG. 4 from which the viscoelastic member is removed.

According to the present invention, the inclination of the slits 11*a* to 13*a* may be different from the above case, like face inserts 11 to 13 shown in FIGS. 4 and 5. In FIGS. 4A and 5A, the forward inclination of the slit 11*a* is milder and in FIGS. 4B and 5B, the slit 12*a* is extended substantially perpendicularly. In FIGS. 4C and 5C, the bottom end of the slit 13*a* is located at a lower portion of the back surface of the face insert 13.

Viscoelastic materials 11*b* to 13*b* are loaded in each of the slits 11*a* to 13*a*. However, it is permissible to mount the face inserts 11 to 13 without the viscoelastic materials 11*b* to 13*b* shown in FIGS. 5A to 5C. on the head main body 2. By loading the viscoelastic material in the slits 11*a* to 13*a*, ball hitting sound or feel on hitting a ball can be adjusted.

Although according to the above-described embodiment, the front surface of the face insert is flat, it is permissible to provide the front surface with several parallel grooves extending laterally. Preferably, the width (vertical width) of the groove is 0.3 to 1.6 mm and the depth of the groove is 0.05 to 1.1 mm.

Although a gap 4 may be formed around the face insert 3, the viscoelastic material 8, such as rubber, elastomer, and synthetic resin may be disposed in this gap. Alternatively, the putter head may be so constructed that the face insert 3 fits firmly to the concave portion 2H without any gap like a putter head 1' shown in FIG. 7.

Figure 6:
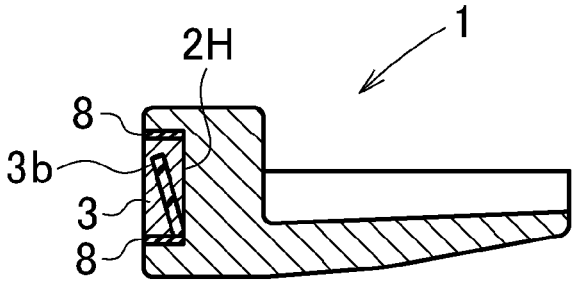
FIG. 6 is a sectional view of a putter head according to a modified example of the first embodiment.
Figure 7A:
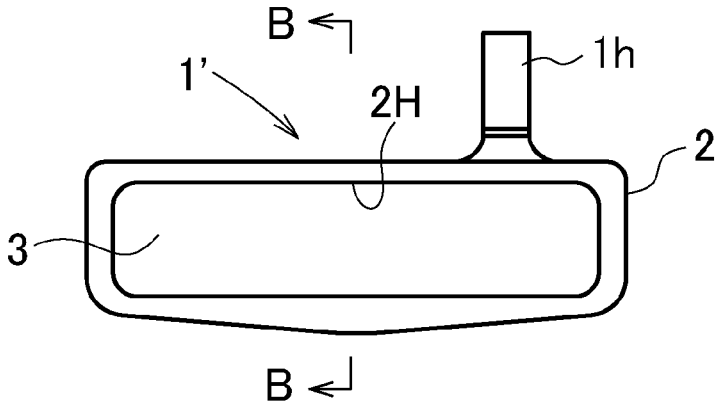
FIG. 7A is a front view of a putter head according to still other modified example.
Figure 7B:
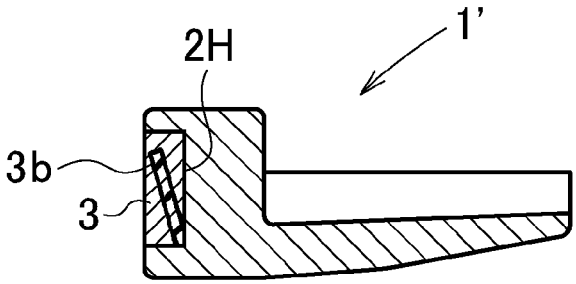
FIG. 7B is a sectional view of the putter head taken along the line B-B of FIG. 7A.

Other configurations of FIGS. 6 and 7 are the same as FIG. 1 and like reference numerals indicate like portions. In the meantime, when the gap 4 or the viscoelastic material 8 is provided between the side face 3S of the face insert 3 and the peripheral face 2S of the concave portion 2H, no residual stress is generated in the face insert, so that the rebound characteristics of the face insert functions as designed, which is an effect of the present invention.

Figure 8A:
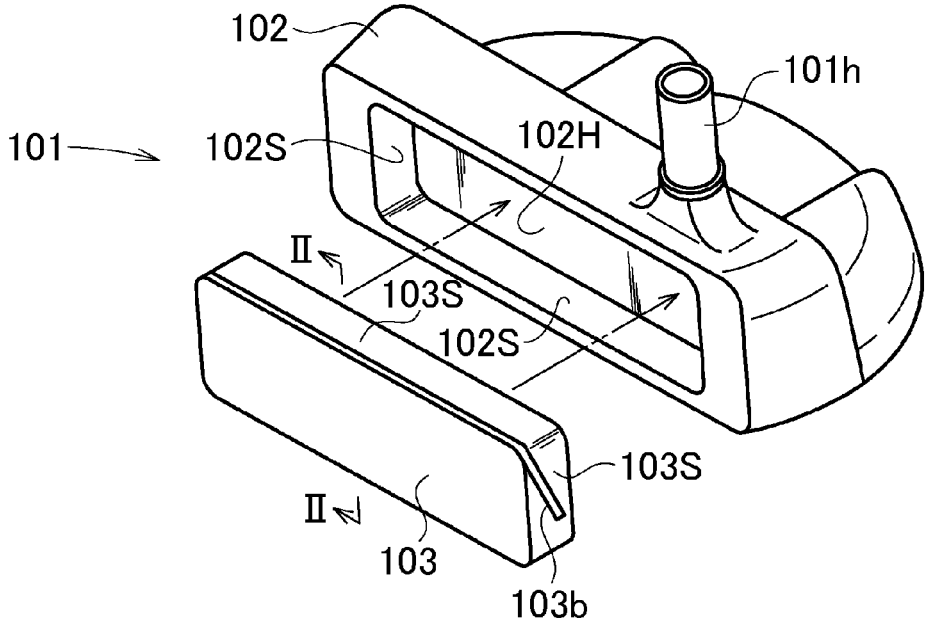
FIG. 8A is an exploded perspective view of a putter head according to a second embodiment of the present invention.
Figure 8B:
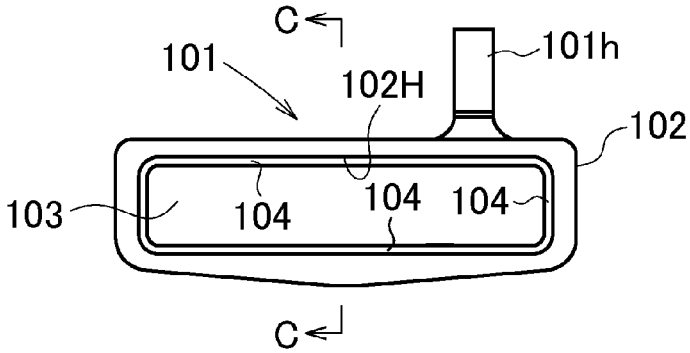
FIG. 8B is a front view of the putter head of FIG. 8A.
Figure 8C:
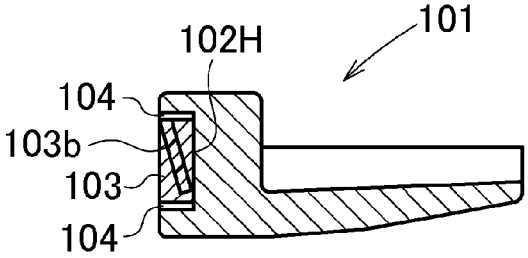
FIG. 8C is a sectional view of the putter head taken along the line C-C of FIG. 8B.
Figure 9:
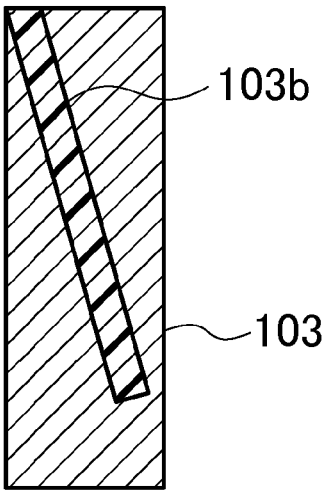
FIG. 9 is a sectional view of the face insert taken along the line II-II of FIG. 8A.

FIGS. 8 and 9 show a putter head 101 according to a second embodiment of the present invention. This putter head 101 is provided with a concave portion 2H in the front face (face surface) of a head main body 102 and a face insert 103 is disposed within this concave portion 102H. The second embodiment has the same configuration as the first embodiment except for the differences described below.

The face insert 103 has a slit 103*a* which is extended downward (toward the sole side) from a top end portion thereof and this slit 103*a* is filled with viscoelastic material 103*b*.

Figure 10:
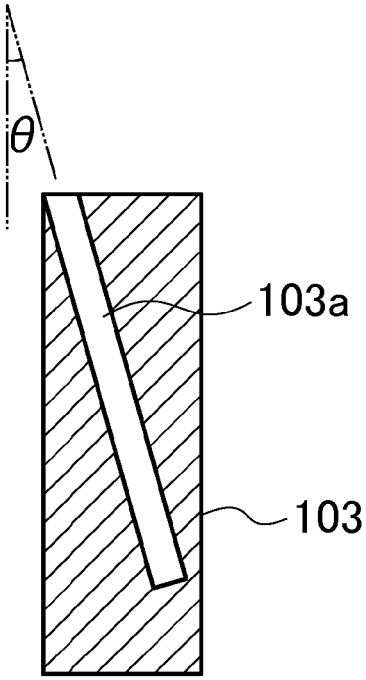
FIG. 10 is a sectional view of the face insert of FIG. 9 from which viscoelastic member is removed.

According to this embodiment, the top end of the slit 103*a* is located on a top side face of the face insert 103 and the slit is extended obliquely such that a lower portion thereof is located rearward of the putter head (rightward in FIGS. 9 and 10).

The slit 103*a* is extended from the left end to the right end of the face insert 103 (from the side face on the toe side to the side face on the heel side). That is, the face insert 103 has a substantially C-shaped configuration directed upward in which its front face side portion and its rear face side portion are combined continuously at a lower portion thereof. An angle θ (FIG. 10) of the slit 3*a* is preferred to be in a range of 0° which means a perpendicular state to the ground to +35° and more preferred to be in a range of 0° to +25°. The depth of the slit 103*a* (a difference in height between the top end and the bottom end of the slit 103*a*) is preferred to be 60 to 95% and more preferred to be 70 to 90%.

The face insert 103 is disposed within the concave portion 2H such that its left side face in FIG. 9 serves as a face surface of the putter head and an opposite side face is bonded to a deep wall surface of the concave portion 102H with adhesive.

The putter is configured by connecting a shaft to a hosel portion 101*h* of the putter head 101 having the above-described configuration. Assuming that a ball is putted with this putter, when the ball is hit, the front face side (face side portion as viewed from the slit 103*a*) of the face insert 103 is retracted slightly. As a result, top spin of the ball is reduced and thereby back spin is more easily applied to the ball. Accordingly, in case of a slightly rough green or a green which ensures an excellent rolling of a ball, a player can adjust his feel on a distance on the green because the rolling performance of the ball is degraded. That is, generally, just after a ball hit with the putter leaves the face surface of the putter, it moves on the green without any rotation or as if it slides at a low rotation rate and after a short time, the ball rolls without sliding on the green due to friction between the ball and the green (the peripheral velocity of the ball becomes equal to a moving velocity of the ball).

If a force in the direction of the top spin is applied to the ball when hit with the putter head or a force in the direction of back spin is applied to the ball when hit, a moving distance without any rotation or at a low rotation rate just after the ball is hit is increased. In a case in which the green surface is rough, an influence which the ball receives from the green surface during moving without any rotation or at a low rotation rate just after the ball is hit is decreased, and consequently, a whole rolling distance until the ball stops becomes substantially equal to a case of ordinary green. In a case of a green which secures an excellent rolling of a ball (more specifically, a green on which the grass is cut short or a green which is hardened by a roller, etc.), the rolling of the ball just after hitting is restrained because the top spin is weakened or the back spin is generated. As a result, the whole rolling distance until the ball is stopped becomes substantially equal to the case of an ordinary green. Accordingly, the putter head of the present invention allows a player to adjust a feeling on a rolling distance when playing on a little rough green or a green which ensures an excellent rolling of a ball, and consequently, the ball rolls over just a distance which the player expects.

Figure 11A:
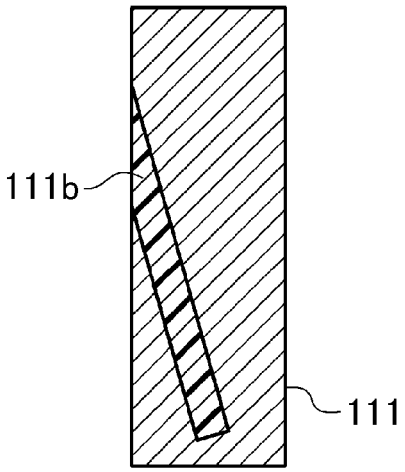
FIG. 11 shows sectional views of face inserts according to modified examples.
Figure 11B:
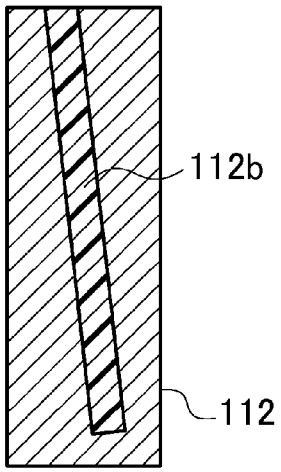
Figure 11C:
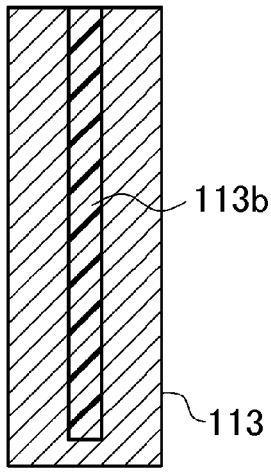
Figure 12A:
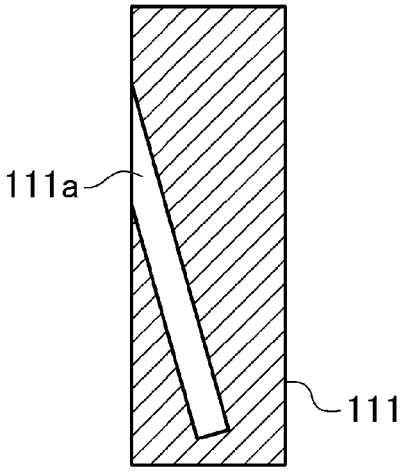
FIG. 12 shows sectional views of the face inserts of FIG. 11 from which the viscoelastic member is removed.
Figure 12B:
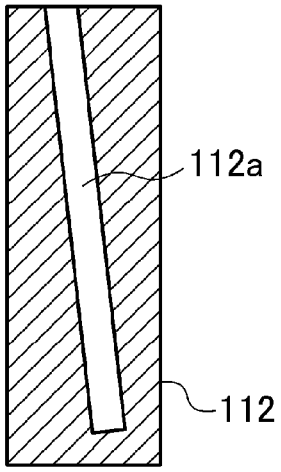
Figure 12C:
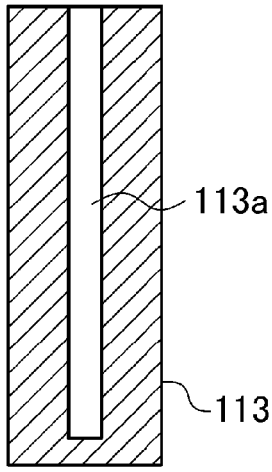

According to the present invention, the inclinations of the slits 111*a* to 113*a* may be different from the above-mentioned cases like the face inserts 111 to 113 shown in FIGS. 11 and 12. In FIGS. 11A and 12A, the forward inclination of the slit 111*a* is intensified and the top end of the slit 111*a* is located at an upper portion of the face surface, more specifically near the center between the top end and the bottom end of the face surface. In FIGS. 11B and 12B, the inclination of the slit 113*a* is mild and the top end of the slit 113*a* is located at a forward portion of the side face on the top end of the face insert 13. In FIGS. 11C and 12C, the slit 13*a* is extended substantially perpendicularly.

The slits 111*a* to 113*a* are filled with viscoelastic materials 111*b* to 113*b*. However, the face inserts 111 to 113 without the viscoelastic materials 111*b* to 113*b* as shown in FIG. 12 may be mounted to the head main body 102. In the meantime, hitting sound and feel on putting a ball can be adjusted by filling the slits 111*a* to 113*a* with viscoelastic material.

Although according to the above-described embodiment, the front surface of the face insert (face insert 113 filled with the viscoelastic material 113*b*) is flat, it is permissible to provide the front surface with several parallel grooves extending laterally.

Figure 13:
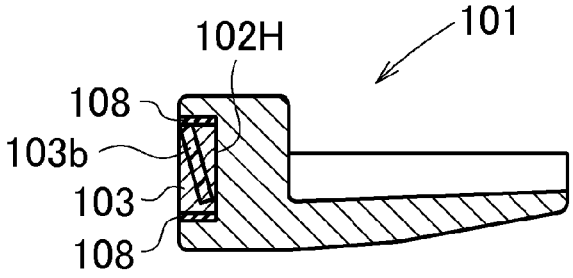
FIG. 13 is a sectional view of the putter head according to a modified example of the second embodiment.

Although in FIG. 8, the gap is formed around the face insert 103, it is permissible to dispose viscoelastic material 108 in this gap as shown in FIG. 13. Alternatively, the putter head may be so constructed that the face insert 103 fits firmly to the concave portion 102H without any gap like a putter head 101' shown in FIG. 14.

Figure 14A:
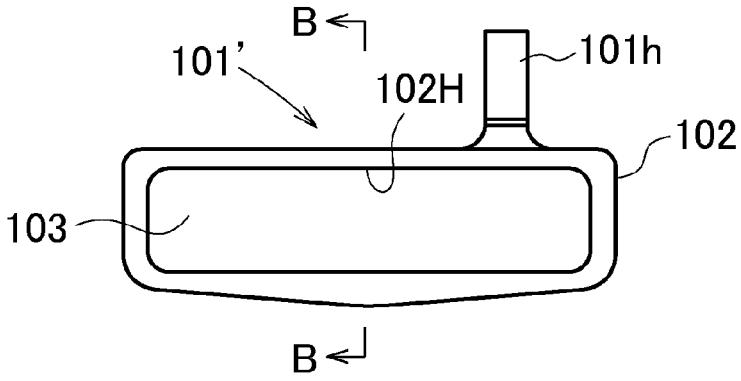
FIG. 14A is a front view of a putter head according to still other example.
Figure 14B:
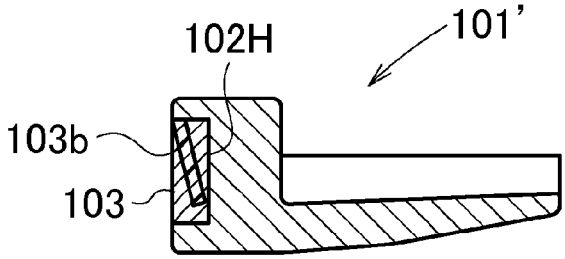
FIG. 14B is a sectional view of the putter head taken along the line B-B of FIG.

Other configurations in FIGS. 13 and 14 are the same as FIG. 8 and like reference numerals indicate like portions. In the meantime, when the gap 104 or the viscoelastic material 108 is provided between the side face 103S of the face insert 103 and the peripheral face 102S of the concave portion 102H, no residual stress is generated in the face insert, and consequently the rebound characteristics of the face insert functions as designed, which is an effect of the present invention.

Figure 15:
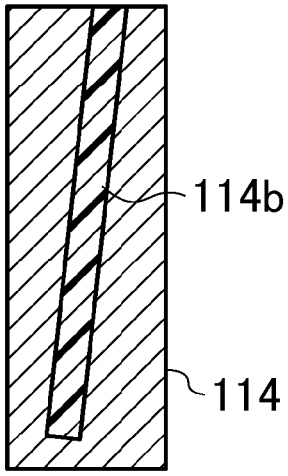
FIG. 15 is a sectional view of a face insert according to still another example.
Figure 16:
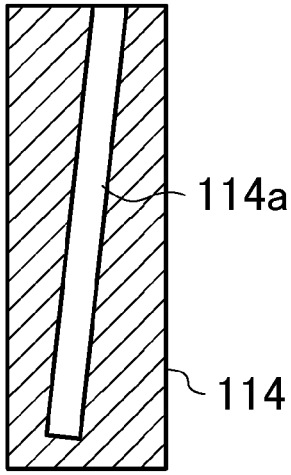
FIG. 16 is a sectional view of the face insert of FIG. 15 from which viscoelastic member is removed.

In the meantime, as shown in a face insert 114 shown in FIGS. 15 and 16, a slit 114*a* filled with a viscoelastic material 114*b* may be extended obliquely such that its lower portion is located forward of the face insert 114 (the slit 114*a* is inclined toward the rear of the face insert 114).

What is claimed is:

1. A putter head comprising:

a head main body having a concave portion in a face surface on a front side thereof; and a face insert disposed within the concave portion of the head main body, a front face of the face insert being flush with a front face of the head main body around the concave portion, wherein the face insert has a slit which is cut in from an end face on a sole side of the face insert toward a top side thereof, wherein a length of the slit between a top side of the slit and a sole side of the slit is 60% to 95% of a length of the face insert measured in a sole to top direction of the putter;

wherein the slit is extended obliquely such that a top side of the slit is located closer to a front side of the head main body than the sole side of the slit.

2. The putter head according to claim 1, wherein the slit is extended from the side face on a toe side of the face insert to the side face on a heel side thereof.

3. The putter head according to claim 1, wherein the face insert contains viscoelastic material loaded in the slit.

4. The putter head according to claim 1, wherein the number of slits is one in the face insert.

5. A putter head comprising:

a head main body having a concave portion in a face surface on a front side thereof; and a face insert disposed within the concave portion of the head main body, a front face of the face insert being flush with the front face of the head main body around the concave portion, wherein the face insert has a slit which is cut in from an end face on a top side of the face insert toward the sole side thereof, wherein a length of the slit between a top side of the slit and a sole side of the slit is 60% to 95% of a length of the face insert measured in a sole to top direction of the putter;

wherein the slit is extended obliquely such that a sole side of the slit is located further from the front side of the head main body than the top side of the slit.

6. The putter head according to claim 5, wherein the slit is extended from the side face on a toe side of the face insert to the side face on a heel side thereof.

7. The putter head according to claim 5, wherein the face insert contains viscoelastic material loaded in the slit.

* * * * *